United States Patent [19]

Rosenberg

[11] Patent Number: 4,783,005

[45] Date of Patent: Nov. 8, 1988

[54] ROTARY SPRINKLER

[76] Inventor: Peretz Rosenberg, Moshav Beit Shearim, Israel

[21] Appl. No.: 60,178

[22] Filed: Jun. 10, 1987

[30] Foreign Application Priority Data

Jul. 1, 1986 [IL] Israel ..... 79297
Mar. 24, 1987 [IL] Israel ..... 81987

[51] Int. Cl.[4] ..... B05B 3/04
[52] U.S. Cl. ..... 239/222.17; 239/381
[58] Field of Search ..... 239/222.17, 222.11, 239/228, 231, 380, 381, 575, 590.5, 214, 204, 205, 206

[56] References Cited

U.S. PATENT DOCUMENTS 538,861 5/1895 Boehmen ..... 239/222.17
2,989,246 6/1961 Sloane ..... 239/204
3,627,205 12/1971 Healy ..... 239/206
4,498,628 2/1985 Tucker ..... 239/381
4,583,689 4/1986 Rosenberg ..... 239/381

*Primary Examiner*—Andres Kashnikow
*Assistant Examiner*—Karen B. Merritt
*Attorney, Agent, or Firm*—Benjamin J. Barish

[57] ABSTRACT

A rotary sprinkler comprises a nozzle, and a rotor floatingly mounted for axial, lateral and rotary movements with respect to the nozzle. The exit end of the nozzle bore is of enlarged diameter to define a cylindrical socket. The rotor includes a stem depending from its underface and floatingly received within the socket, and is formed with a single groove extending axially of the stem and merging with the underface of the rotor. The cylindrical socket in the nozzle is formed with a plurality of ribs defining recesses between them for accumulating solid particles in the water.

6 Claims, 2 Drawing Sheets

FIG 1
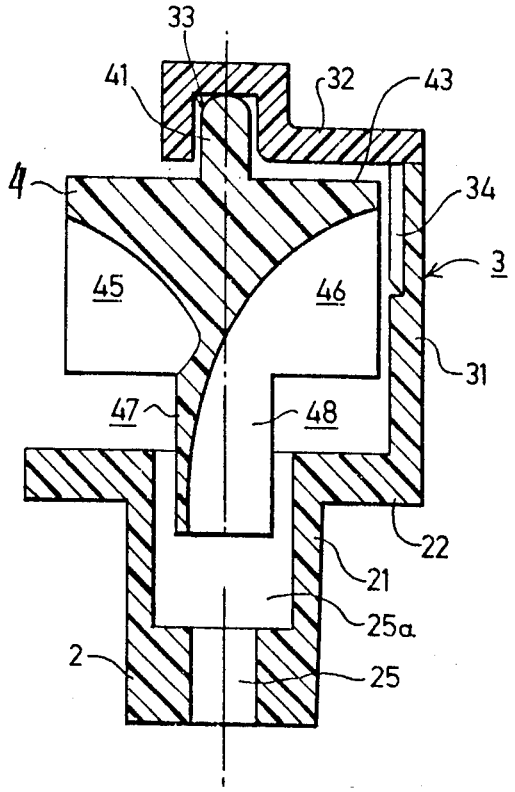
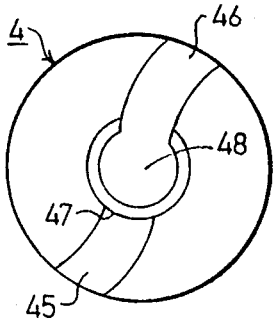
FIG 2
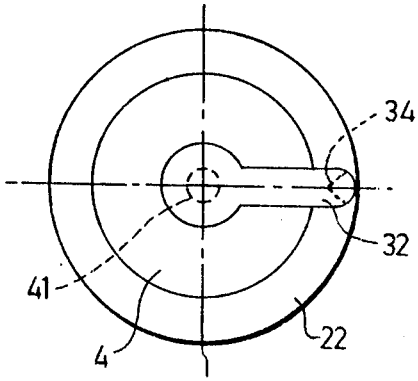
FIG. 3

FIG 4
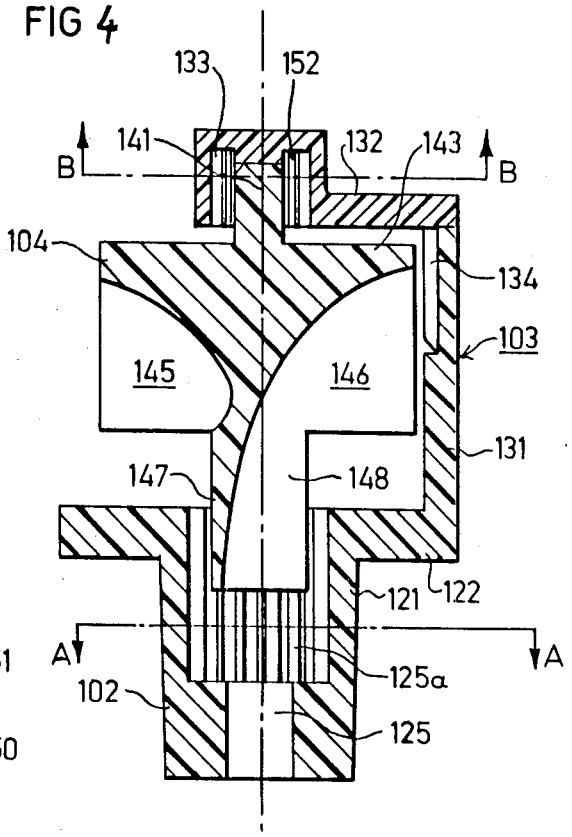
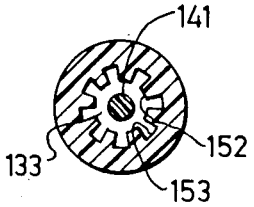
FIG 5b
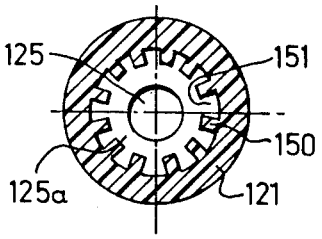
FIG 5a

ROTARY SPRINKLER

BACKGROUND OF THE INVENTION

The present invention relates to rotary sprinklers, particularly to the type illustrated in my prior U.S. Pat. No. 4,583,689.

U.S. Pat. No. 4,583,689 discloses a rotary sprinkler comprising a nozzle having an inlet end connectible to a source of pressurized water and formed with a central axial bore having an exit end through which the water exits in the form of an axial jet, a rotor in the path of the axial jet, and means for floating mounting the rotor for axial, lateral and rotary movements with respect to the nozzle bore. The underface of the rotor is formed for deflecting the jet laterally of the sprinker and for imparting a rotary motion to the rotor. The exit end of the nozzle bore is of an enlarged diameter to define a cylindrical socket, and the rotor includes a stem depending from its underface and floatingly received within the socket. The rotor stem has an outer diameter smaller than the diameter of the nozzle socket to permit axial, lateral, and rotary movements of the rotor stem in the socket.

BRIEF SUMMARY OF THE INVENTION

In the embodiments of the invention described therein, the underface of the rotor is formed with two (or more) grooves extending from the rotor center to the outer edge, and the rotor stem is likewise formed with two (or more) grooves extending axially thereof and merging with the two grooves in the underface of the rotor. While such an arrangement has been found very effective to decrease the divergence of the laterally-deflected jet, to decrease the friction during the rotation of the rotor, and also to decrease the sensitivity of the sprinkler to clogging by particles in the water, I have now found that even better results in the above respects are obtained when the rotor stem is formed with but a single groove extending axially thereof and merging with one of the grooves formed in the underface of the rotor.

With such an arrangement, I have found that the sprinkler exhibits even less sensitivity to clogging because there is virtually no possibility for elongated clogging particles, such as algae, to engage the opposite sides of the flow-divider edge of the rotor stem dividing the axial jet into the two subjets directed to flow through the two axial grooves. Thus, by providing but a single groove axially of the rotor stem merging with a single groove formed on the underface of the rotor, there is substantially less clogging of the rotary sprinkler particularly when the water contains elongated clogging particles such as algae.

I have also found that a rotary sprinkler including but a single axial groove produces less mist, since the axial jet no longer impacts against a flow divider edge which contributes to the mist. Accordingly, the output of such a rotary sprinkler has a better distribution and more wind resistance than that of the sprinkler wherein the axial jet is directed through two axial grooves.

I have further found that a sprinkler constructed in accordance with the foregoing features and having but a single axial groove produces a greater range and a larger rotary torque, and exhibits less sensitivity to pressure changes than the sprinklers including two axial grooves, thereby enabling the novel sprinkler to operate at lower line pressures.

Although the jet in the novel sprinkler is not divided into two subjets, nevertheless it is preferred to have the underface of the rotor formed with two diametrically opposed grooves extending from the rotor center to the outer edge. One of these grooves merges with the single groove extending axially of the rotor stem for receiving the axial jet, while the other groove serves to balance the rotor during its rotation.

According to another feature of the present invention, the cylindrical socket in the nozzle is formed with a plurality of axially-extending, circumferentially-spaced ribs defining recesses between the ribs for accumulating solid particles in the water supply, thereby decreasing the sensitivity of the sprinkler to blocking of the rotor rotation by such solid particles.

The above-cited U.S. Pat. No. 4,583,689 discloses a sprinkler of the foregoing type wherein the mounting means further comprises a bridge secured to the nozzle and formed with a second cylindrical socket rotatably receiving a second cylindrical stem formed in the upper face of the rotor. According to a further feature of the present invention, the second cylindrical socket is also formed with a plurality of axially-extending, circumferentially-spaced ribs defining recesses between the ribs for accumulating solid particles in the water supply.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a longitudinal-sectional view illustrating one form of rotary sprinkler constructed in accordance with the invention of the present application;

FIG. 2 is a bottom view of the rotor in the sprinkler of FIG. 1;

FIG. 3 is a top plan view of the sprinkler of FIG. 1;

FIG. 4 is a longitudinal sectional view illustrating another form of rotary sprinkler constructed in accordance with the present invention; and FIGS. 5*a* and 5*b* are sectional views along lines A—A and B—B, respectively, of FIG. 4.

DESCRIPTION OF PREFERRED EMBODIMENTS

The Embodiment of FIGS. 1—3

The rotary sprinkler illustrated in FIGS. 1–3 of the drawings is of the general type described in U.S. Pat. No. 4,583,689. It includes a nozzle 2 connectible to a pressurized water supply pipe, and a rotor 4 floatingly mounted on the nozzle for rotary and axial movement. In this type of rotary sprinkler, the floating mounting of the rotor is effected by a bridge 3 secured to nozzle 2.

Nozzle 2 includes a body section 21 and a radially-extended wall section 22, both sections being formed with an axially-extending bore 25 whose outlet end is of enlarged diameter to define a socket 25*a* for accomodating the lower stem 47 of rotor 4. The underface of the rotor 4 is further formed with a pair of diametrically-opposed grooves 45, 46, which extend from the center of the rotor to its outer edge.

In U.S. Pat. No. 4,583,689, the rotor stem 47 is further formed with a pair of axially-extending grooves merging with grooves 45 and 46. In the present invention, however, the rotor is formed with but a single axially-extending groove 48, merging with groove 46; thus, the rotor stem 42 does not include a groove merging with the rotor groove 45, but rather the later groove is provided merely for balancing purposes.

Bridge 3 includes a vertically-extending leg 31 integrally formed with, or otherwise secured to, nozzle 2. Leg 31 is disposed laterally of rotor 4, and includes a horizontally-extending leg 32 overlying the upper end of the rotor. Leg 32 is formed with a socket 33 for rotatably receiving the upper stem 41 of the rotor. In addition, the upper portion of vertical leg 31 includes a section which decreases in thickness towards the rotor so as to form a shaped, pointed edge 34 which deflects the single lateral jet when impinging thereon, to opposite sides of this leg.

It will thus be seen that the construction and operation of the rotary sprinkler illustrated in the drawings of this application is the same as described in U.S. Pat. No. 4,583,689, except that whereas the latter sprinkler includes two axially-extending grooves formed in the rotor stem 47, the rotary sprinkler of the present application includes but a single such groove, namely groove 48, merging with groove 46 formed in the underface of the rotor; as indicated above, the second goove 45 in the underface of the rotor is provided for balancing purposes. Thus, the complete jet discharged by bore 25 will be received within groove 48 and will be directed by that groove to groove 46 formed in the underface of rotor 4, so that the rotary sprinkler will discharge but a single jet laterally of the sprinkler rather than two jets as in the rotary sprinkler described in U.S. Pat. No. 4,583,689. As mentioned above, it has been found that such a construction reduces vary substantially the tendency of the rotary sprinkler to clog, particularly when the irrigating water includes elongated clogging particles such as algae. It has also been found that this novel construction produces less mist because there is no impacting against a flow-divider edge, thereby producing a better water distribution and more wind resistance. Further, the novel sprinkler has also been found to produce a greater range and a large torque, thereby enabling the sprinkler to be operated with lower water pressures.

The Embodiment of FIGS. 4, 5*a*, 5*b*

The sprinkler illustrated in FIGS. 4, 5*a*, 5*b* includes a nozzle 102 connectable to a pressurized water supply line (not shown), a bridge 103, and a rotor 104 floatingly mounted between the nozzle and the bridge for axial, lateral and rotary movements with respect to the nozzle.

Nozzle 102 includes a body section 121 and a radially-extending wall section 122. Both sections are formed with an axially-extending bore 125 whose outlet end is of enlarged diameter to define a socket 125*a* for accommodating the lower stem 147 of rotor 104. The underface of rotor 104 is further formed with a pair of diametrically opposed grooves 145, 146, which extend from the center of the rotor to its outer edge. The rotor is further formed with but a single axially-extending groove 148 merging with groove 146. Thus, the rotor stem 147 does not include a groove merging with rotor groove 145, but rather the latter groove is provided merely for balancing purposes.

Bridge 103 includes a vertically-extending leg 131 integrally formed with nozzle 102. Leg 131 is disposed laterally of rotor 104, and includes a horizontally-extending leg 132 overlying the upper end of the rotor. Leg 132 is formed with a socket 133 for rotatably receiving the upper stem 145 of the rotor. In addition, the upper portion of vertical leg 131 includes a section which decreases in thickness towards the rotor so as to form a shaped, pointed edge 134 which deflects the single lateral jet, when impinging thereon, to opposite sides of this leg.

It will thus be seen that the complete jet discharged from bore 125 will be received within groove 148 and will be directed by that groove to groove 146 formed in the underface of rotor 104, so that the rotary sprinkler will discharge but a single jet laterally of the sprinkler.

Cylindrical socket 125*a* is formed with a plurality of axially-extending circumferentially-spaced ribs 150 defining recesses 151 between the ribs. Socket 133 in leg 132 of bridge 103 is also formed with a plurality of axially-extending, circumferentially-spaced ribs 152 defining recesses 153 between those ribs.

The construction of FIG. 4, 5*a*, 5*b* is particularly advantageous when the rotary sprinkler is used with a poor grade of water, i.e., water containing a relatively large amount of sand or other solid particles. Thus, in the construction of FIGS. 1–3, wherein sockets 25*a* and 33 are smooth-surface cylindrical sockets, sand or other solid particles in the water supply may become wedged between the outer surface of the respective stem and the socket, such as to block the rotation of the rotor 104. In the construction illustrated in FIGS. 4, 5*a* and 5*b*, however, the recesses 151 and 153, respectively, tend to accumulate the sand or other solid particles in the water supply so as to prevent them from becoming wedged between the rotor stem and the socket wall. The particles received within the lower recesses 151 are continuously flushed out by the water jet passing through nozzle bore 125; whereas the solid particles accumulating in recesses 153 in the upper socket 133 tend to drop out by gravity on to the upper face of rotor 104 and are ejected outwardly of the sprinkler by centrifugal force during the rotation of the rotor.

Thus, it has been found that the construction of the rotary sprinkler illustrated in FIGS. 4, 5*a*, 5*b* substantially decreases the sensitivity of the sprinkler to blocking of the rotor rotation by sand or other solid particles in the water supply even when the water supply is of poor quality and includes a relatively large amount of sand or other solid particles.

While the invention has been described with respect to two preferred embodiments, it will be appreciated that many variations and modifications may be made. For example, the undersurface of the rotor, instead of being provided with the grooves, could be provided with abutments which also cause the rotor to be rotated and the axial jet to be deflected laterally of the sprinkler. Other variations, modifications and applications of the invention will be apparent.

What is claimed is:

1. A rotary sprinkler comprising a nozzle having an inlet and connectable to source of pressurized water and formed with central axial bore having an exit end through which the water exits in the form of an axial jet, a rotor in the path of the axial jet, and means for floatingly mounting the rotor for axial, lateral and rotary movements with respect to the axial bore, the underface of said rotor being formed to deflect the jet laterally of the sprinkler and to impart a rotary motion to the rotor; the exit end of said nozzle bore being of enlarged diameter to define a cylindrical socket; said rotor including a stem depending from its underface and floatingly received within said socket, and having an outer diameter smaller than the diameter of the socket for axial, lateral and rotary movement therein; said rotor stem being formed with a single groove extending axially thereof and merging with the underface of the rotor; the underface of said rotor being formed with two diametrically opposed grooves extending from the rotor center to its outer edge, one of said grooves merging with said single groove extending axially of the rotor stem for receiving the axial jet, the other of said grooves balancing the rotor during its rotation.

2. The rotary sprinkler according to claim 1, wherein said means floatingly mounting said rotor comprises a bridge having one end secured to said nozzle and extending laterally of said rotor, the opposite end of said bridge being formed with a recess rotatably receiving a stem formed in the upper face of said rotor.

3. The rotary sprinkler according to claim 1, wherein said cylindrical socket in the nozzle is formed with a plurality of axially-extending, circumferentially-spaced ribs defining recesses between the ribs for accumulating solid particles in the water supply, thereby decreasing the sensitivity of the sprinkler to blocking of the rotor rotation by such solid particles.

4. The rotary sprinker according to claim 3, wherein said mounting means further comprises a bridge secured to the nozzle and formed with a second cylindrical socket rotatably receiving a second cylindrical stem formed in the upper face of the rotor; said second cylindrical socket also being formed with a plurality of axially-extending, circumferentially-spaced ribs defining recesses between the ribs for accumulating solid particles in the water supply.

5. A rotary sprinkler comprising a nozzle having an inlet end connectable to a pressurized water supply and formed with a central bore having an exit end through which the water exits in the form of an axial jet, said exit end being of enlarged diameter to define a cylindrical socket; a rotor in the path of the axial jet and having an underface formed with two diametrically opposed grooves to deflect the jet laterally of the sprinkler and to impart a rotary motion to the rotor; and mounting means for floatingly mounting the rotor for axial, lateral and rotary movements with respect to the nozzle bore; said mounting means comprising a cylindrical stem depending from the underface of the rotor and of smaller outer diameter than the diameter of the socket; said cylindrical stem being formed with a single groove extending axially thereof and merging with one of the grooves formed in the underface of said rotor; said cylindrical socket in the nozzle being formed with a plurality of axially-extending, circumferentially-spaced ribs defining recesses between the ribs for accumulating solid particles in the water supply, thereby decreasing the sensitivity of the sprinkler to blocking of the rotor rotation by such solid particles.

6. The rotary sprinkler according to claim 5, wherein said mounting means further comprises a bridge secured to the nozzle and formed with a second cylindrical socket rotatably receiving a second cylindrical stem formed in the upper face of the rotor; said second cylindrical socket also being formed with a plurality of axially-extending, circumferentially-spaced ribs defining recesses between the ribs for accumulating solid particles in the water supply.

* * * * *